US008177146B2

(12) United States Patent
Chen

(10) Patent No.: US 8,177,146 B2
(45) Date of Patent: May 15, 2012

(54) SHOWER HEAD HAVING A LARGER FLUSHING ANGLE

(75) Inventor: Kun-Chih Chen, Changhua Hsien (TW)

(73) Assignee: Sunrise Shower Products Co. Ltd., Changhua (TW)

( * ) Notice: Subject to any disclaimer, the term of this patent is extended or adjusted under 35 U.S.C. 154(b) by 212 days.

(21) Appl. No.: 12/773,049

(22) Filed: May 4, 2010

(65) Prior Publication Data

US 2011/0272496 A1 Nov. 10, 2011

(51) Int. Cl.
*E03C 1/08* (2006.01)

(52) U.S. Cl. ..... 239/428.5; 239/553; 239/587.4; 239/590

(58) Field of Classification Search ..... 239/423, 239/425.5, 428.5, 433, 434, 553, 587.4, 590
See application file for complete search history.

(56) References Cited

U.S. PATENT DOCUMENTS 2,156,800 A * 5/1939 Bucknell et al. ..... 239/457
2,557,106 A * 6/1951 Hughes ..... 239/438
3,322,352 A * 5/1967 Alcantara ..... 239/428.5
4,346,844 A * 8/1982 Harmony ..... 239/381
4,573,639 A * 3/1986 Logue ..... 239/428.5
5,111,994 A * 5/1992 Gonzalez ..... 239/428.5
5,154,355 A * 10/1992 Gonzalez ..... 239/428.5
5,826,799 A * 10/1998 Hsieh ..... 239/428.5
6,343,750 B1 * 2/2002 Engel ..... 239/463
6,796,518 B2 * 9/2004 Douglas et al. ..... 239/587.4
7,611,070 B2 * 11/2009 Paoluccio ..... 239/9
7,975,936 B2 * 7/2011 Paoluccio ..... 239/9

* cited by examiner

*Primary Examiner* — Christopher Kim
(74) *Attorney, Agent, or Firm* — Che-Yang Chen; Law Office of Michael Chen

(57) ABSTRACT

A shower head includes a nozzle unit, a quick connector mounted on the nozzle unit, and a bushing mounted in the quick connector. Thus, when the water flows through the shower head, the ambient air is introduced through the air conducting holes of the quick connector and the air conducting apertures of the bushing into the flow conduit of the bushing to break the vacuum state in the shower head and to perturb the water flow in the shower head so as to produce a turbulent flow in the shower head so that the water flow injected from the nozzle unit is divided into multiple straight water beams and multiple irregular water bubbles so as to increase the flushing angle and area of the shower head.

4 Claims, 6 Drawing Sheets

SHOWER HEAD HAVING A LARGER FLUSHING ANGLE

BACKGROUND OF THE INVENTION

1. Field of the Invention

The present invention relates to a shower head and, more particularly, to a shower head for a bathroom.

2. Description of the Related Art

A conventional shower head 50 in accordance with the prior art shown in FIGS. 5 and 6 comprises a nozzle 54, a connector 53 mounted on an open top of the nozzle 54, a sealing ring 542 mounted in the open top of the nozzle 54 and located between the connector 53 and the nozzle 54, a fastening member 52 secured on the open top of the nozzle 54 and abutting the connector 53 to limit the connector 53 on the nozzle 54, and a locking screw member 51 locked onto the connector 53. The nozzle 54 has a peripheral wall provided with a control handle 541 to regulate a water flow injected from the nozzle 54. The open top of the nozzle 54 has an outer portion formed with an outer threaded portion 543. The connector 53 has a first end provided with a spherical body 532 rotatably mounted on the open top of the nozzle 54 and abutting the sealing ring 542 and has a second end provided with a threaded tube 531. The connector 53 has an inner portion formed with a mounting hole 533. The mounting hole 533 of the connector 53 has a bottom formed with a reduced water outlet 534. The fastening member 52 has an inner wall formed with an inner threaded portion 522 screwed onto the outer threaded portion 543 of the nozzle 54 to lock the fastening member 52 onto of the nozzle 54. The fastening member 52 has a top formed with a reduced limit hole 521 mounted on the spherical body 532 of the connector 53 so that the threaded tube 531 of the connector 53 protrudes outward from the limit hole 521 of the fastening member 52. The locking screw member 51 has a first end formed with a screw bore 512 screwed onto the threaded tube 531 of the connector 53 to lock the locking screw member 51 onto the connector 53. The locking screw member 51 has a second end formed with a water inlet port 511 that is connected to a water source (not shown). In operation, when the water inlet port 511 of the locking screw member 51 is connected to the water source, the water from the water source in turn flows through the water inlet port 511 of the locking screw member 51, the mounting hole 533 of the connector 53 and the water outlet 534 of the connector 53 into the nozzle 54 and is injected outward from the nozzle 54 for use with a user.

However, when the water inlet port 511 of the locking screw member 51 is connected to the water source, a closed vacuum condition is formed in the inner space of the shower head 50 so that the inner space of the shower head 50 has a larger water pressure to push and inject the water from the nozzle 54 quickly and violently to form multiple concentrated and convergent water beams, thereby decreasing the flushing angle and area of the shower head 50. In addition, the water beams are injected outward from the nozzle 54 strongly due to the larger water pressure in the shower head 50, thereby easily causing an uncomfortable sensation to the user.

BRIEF SUMMARY OF THE INVENTION

In accordance with the present invention, there is provided a shower head, comprising a nozzle unit, a quick connector mounted on the nozzle unit, and a bushing mounted in the quick connector. The nozzle unit includes a nozzle, a universal connector having a spherical first end rotatably mounted on the nozzle, and a locking screw member mounted on a second end of the universal connector. The quick connector has a first end provided with an outer threaded portion screwed into the locking screw member of the nozzle unit. The quick connector has a second end provided with a threaded mounting portion. The quick connector has an inner portion formed with a flow channel. The flow channel of the quick connector has a bottom formed with a reduced water outlet which has a diameter smaller than that of the flow channel. The quick connector has a peripheral wall formed with two radially opposite air conducting holes. The air conducting holes of the quick connector are connected to the flow channel. The flow channel of the quick connector has a peripheral wall formed with two radially opposite limit portions. The bushing is fully received in the flow channel of the quick connector and has an inner wall formed with a flow conduit connected to the flow channel of the quick connector. The bushing has a peripheral wall formed with two radially opposite air conducting apertures aligning with the air conducting holes of the quick connector respectively. The air conducting apertures of the bushing are connected to the flow conduit. The bushing has an outer wall formed with two radially opposite locking portions locked in the limit portions of the quick connector. The primary objective of the present invention is to provide a shower head having a larger flushing angle.

According to the primary advantage of the present invention, when the water flows through the shower head, the ambient air is introduced through the air conducting holes of the quick connector and the air conducting apertures of the bushing into the flow conduit of the bushing to break the vacuum state in the shower head and to perturb the water flow in the shower head so as to produce a turbulent flow in the shower head so that the water flow injected from the nozzle unit is broken and divided into multiple straight water beams and multiple irregular water bubbles so as to increase the flushing angle and area of the shower head and to enhance the water flushing effect of the shower head.

According to another advantage of the present invention, the ambient air is introduced through the air conducting holes of the quick connector and the air conducting apertures of the bushing into the flow conduit of the bushing to reduce the water pressure in the shower head so that the water is injected from the nozzle unit smoothly and stably so as to provide a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
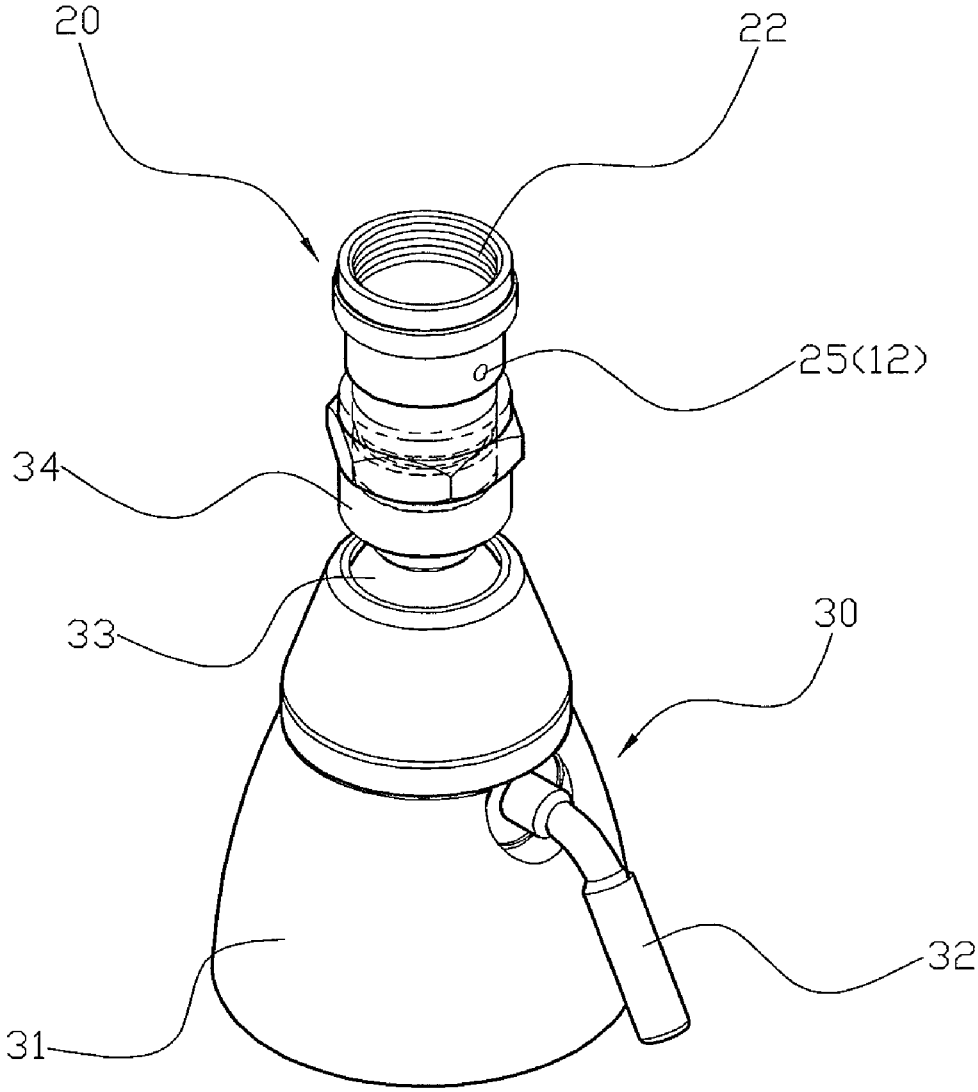
FIG. 1 is a perspective view of a shower head in accordance with the preferred embodiment of the present invention.
Figure 2:
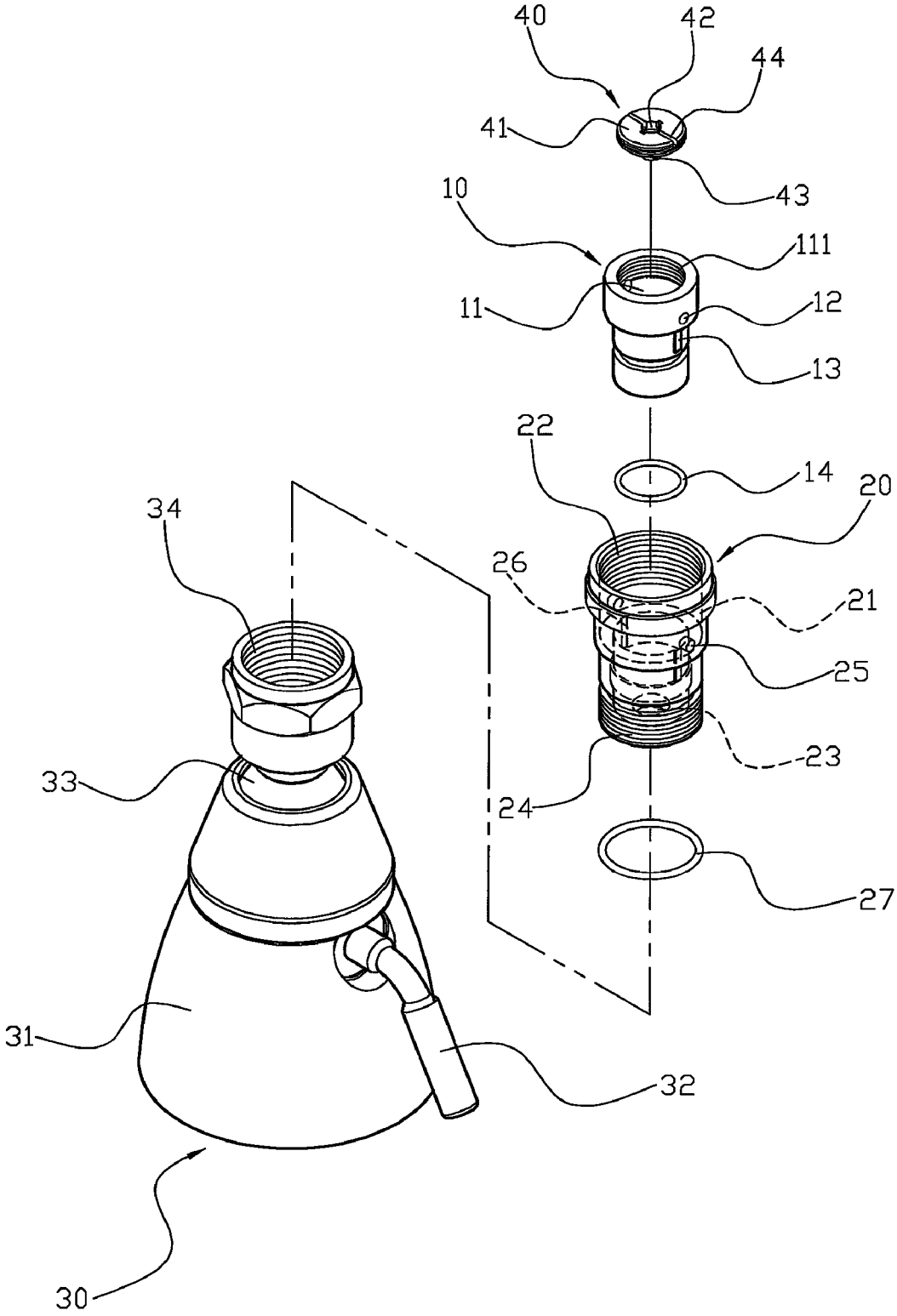
FIG. 2 is an exploded perspective view of the shower head as shown in FIG. 1.
Figure 3:
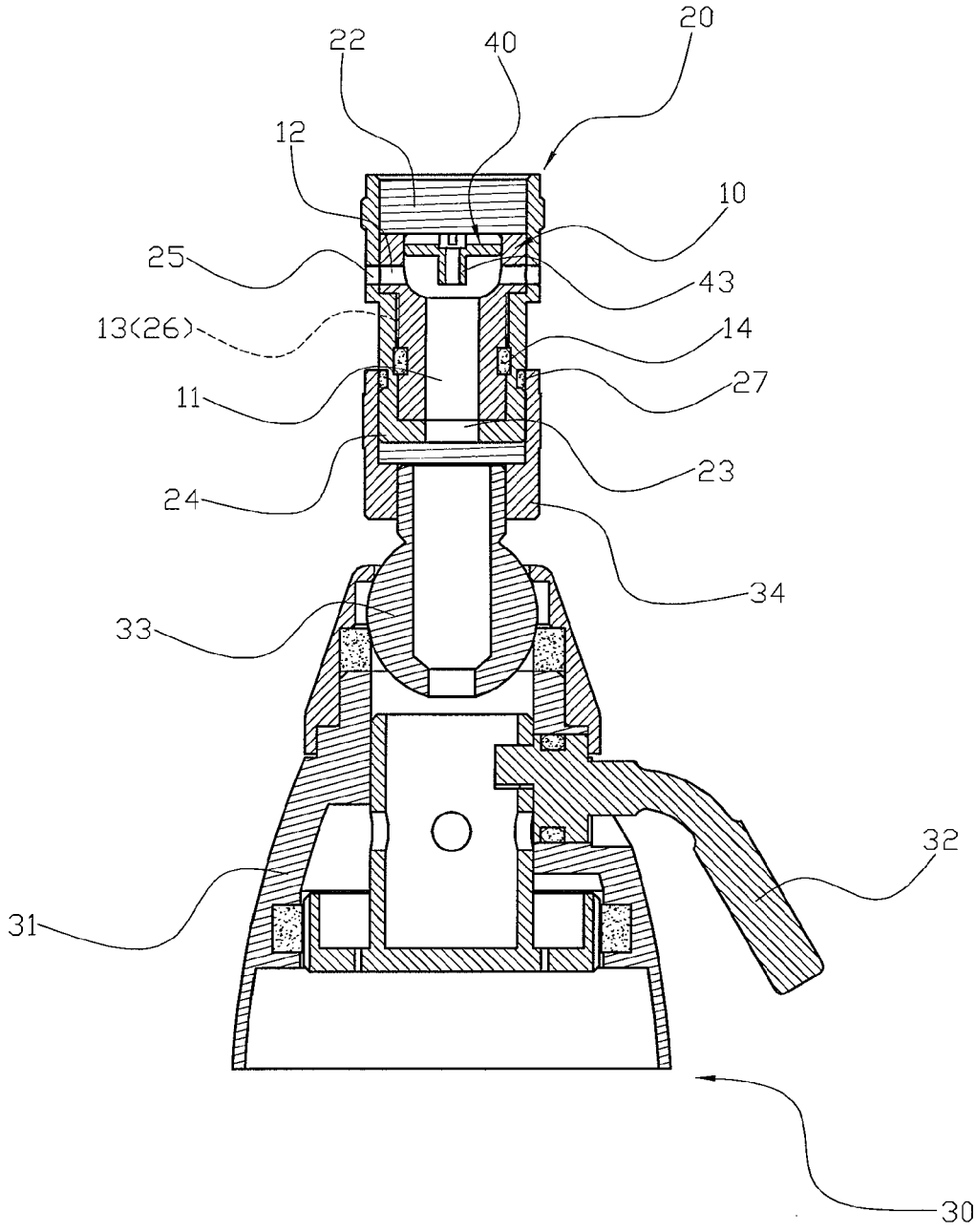
FIG. 3 is a front cross-sectional view of the shower head as shown in FIG. 1.

Referring to the drawings and initially to FIGS. 1-3, a shower head in accordance with the preferred embodiment of the present invention comprises a nozzle unit 30, a quick connector 20 mounted on the nozzle unit 30, and a bushing 10 mounted in the quick connector 20.

The nozzle unit 30 includes a nozzle 31, a universal connector 33 having a spherical first end rotatably mounted on the nozzle 31, and a locking screw member 34 mounted on a second end of the universal connector 33. The nozzle 31 of the nozzle unit 30 has a peripheral wall provided with a control handle 32 to regulate a water flow injected from the nozzle 31 of the nozzle unit 30.

The quick connector 20 has a first end provided with an outer threaded portion 24 screwed into the locking screw member 34 of the nozzle unit 30. The quick connector 20 has a second end provided with a threaded mounting portion 22 that is connected to a water source (not shown). The quick connector 20 has an inner portion formed with a stepped flow channel 21. The flow channel 21 of the quick connector 20 extends axially through the quick connector 20 and has a bottom formed with a reduced water outlet 23 which has a diameter smaller than that of the flow channel 21. The water outlet 23 of the quick connector 20 is formed on the second end of the quick connector 20. The quick connector 20 has a peripheral wall formed with two radially opposite air conducting holes 25. The air conducting holes 25 of the quick connector 20 are connected to the flow channel 21. The air conducting holes 25 of the quick connector 20 are disposed between the outer threaded portion 24 and the threaded mounting portion 22 of the quick connector 20. The flow channel 21 of the quick connector 20 has a peripheral wall formed with two radially opposite limit portions 26. Each of the limit portions 26 of the quick connector 20 is an elongate slot which extends axially in the flow channel 21 of the quick connector 20.

The bushing 10 is a hollow stepped cylinder that is made of plastic material. The bushing 10 is fully received in the flow channel 21 of the quick connector 20 and has an inner wall formed with a flow conduit 11 connected to the flow channel 21 of the quick connector 20. The flow conduit 11 of the bushing 10 extends axially through the bushing 10 and is connected between the flow channel 21 and the water outlet 23 of the quick connector 20. The flow conduit 11 of the bushing 10 has a circular shape and has an upper end formed with an inner threaded section 111. The bushing 10 has a peripheral wall formed with two radially opposite air conducting apertures 12 aligning with the air conducting holes 25 of the quick connector 20 respectively. The air conducting apertures 12 of the bushing 10 are connected to the flow conduit 11. The bushing 10 has an outer wall formed with two radially opposite locking portions 13 locked in the limit portions 26 of the quick connector 20 so that the bushing 10 is positioned in the flow channel 21 of the quick connector 20 exactly. Each of the locking portions 13 of the bushing 10 is an elongate rib which extends axially on the bushing 10.

The shower head further comprises a first O-ring 14 mounted on the outer wall of the bushing 10 and located in the flow channel 21 of the quick connector 20, and a second O-ring 27 mounted on the outer wall of the quick connector 20 and located in the locking screw member 34 of the nozzle unit 30. The first O-ring 14 is pressed between the bushing 10 and the quick connector 20 to provide an air-tight effect between the bushing 10 and the quick connector 20. The second O-ring 27 is pressed between the quick connector 20 and the locking screw member 34 of the nozzle unit 30 to provide an air-tight effect between the quick connector 20 and the locking screw member 34 of the nozzle unit 30.

The shower head further comprises a flow guide member 40 secured in the flow conduit 11 of the bushing 10 to interrupt the flow conduit 11 of the bushing 10. The flow guide member 40 has an upper end provided with a threaded disk 41 screwed into the inner threaded section 111 of the bushing 10. The threaded disk 41 of the flow guide member 40 has a top whose height is higher than that of each of the air conducting apertures 12 of the bushing 10. The flow guide member 40 has a second end provided with a flow tube 43 which is extended into the flow conduit 11 of the bushing 10. The flow tube 43 of the flow guide member 40 has a bottom whose height is lower than that of each of the air conducting apertures 12 of the bushing 10. The flow guide member 40 has an inner portion formed with a through hole 42 which is connected between the flow channel 21 of the quick connector 20 and the flow conduit 11 of the bushing 10. The through hole 42 of the flow guide member 40 extends axially through the threaded disk 41 and the flow tube 43 of the flow guide member 40. The flow guide member 40 has a top face formed with an elongate tool insertion slit 44 to allow insertion of a hand tool (not shown), such as a screwdriver and the like.

Figure 4:
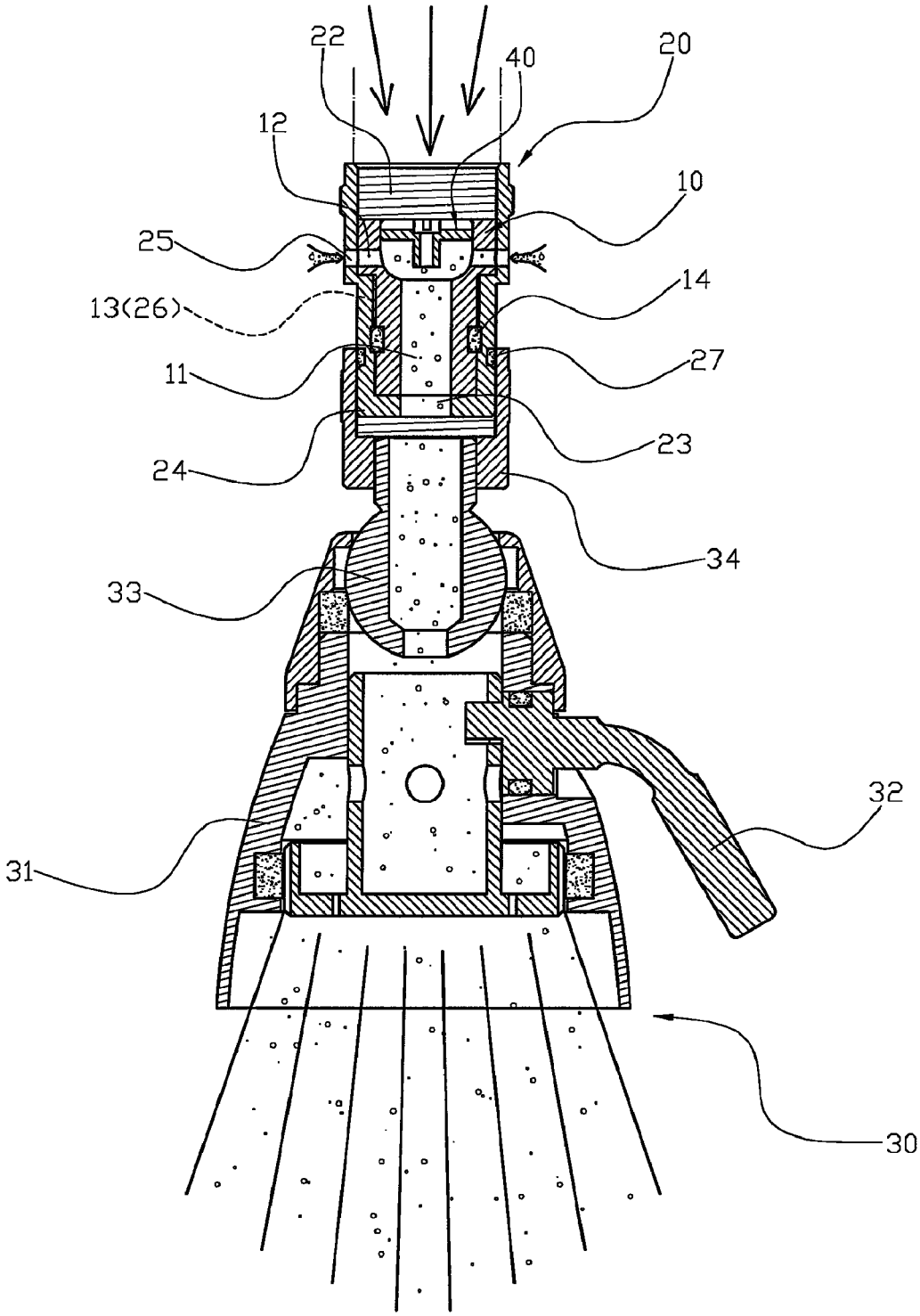
FIG. 4 is a schematic operational view of the shower head as shown in FIG. 3 in use.
Figure 5:
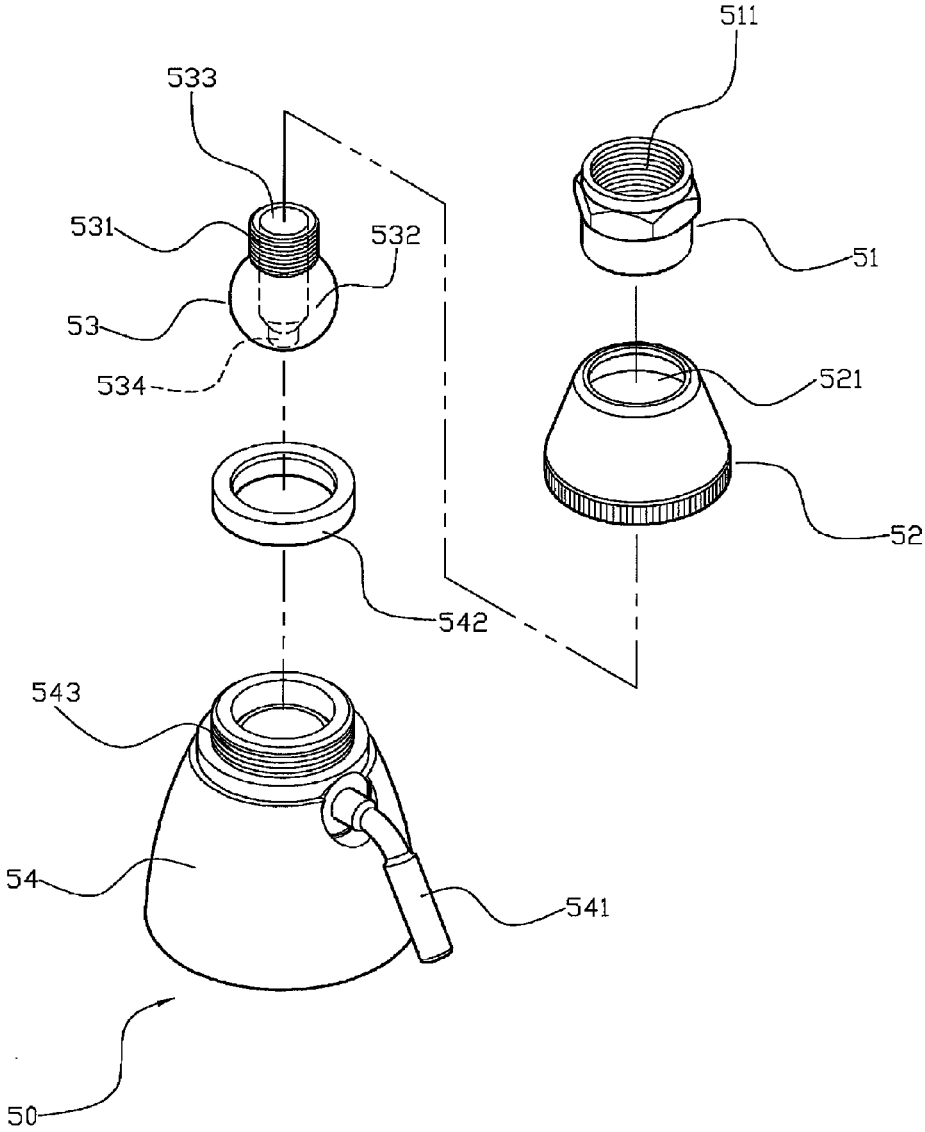
FIG. 5 PRIOR ART
FIG. 5 is an exploded perspective view of a conventional shower head in accordance with the prior art.
Figure 6:
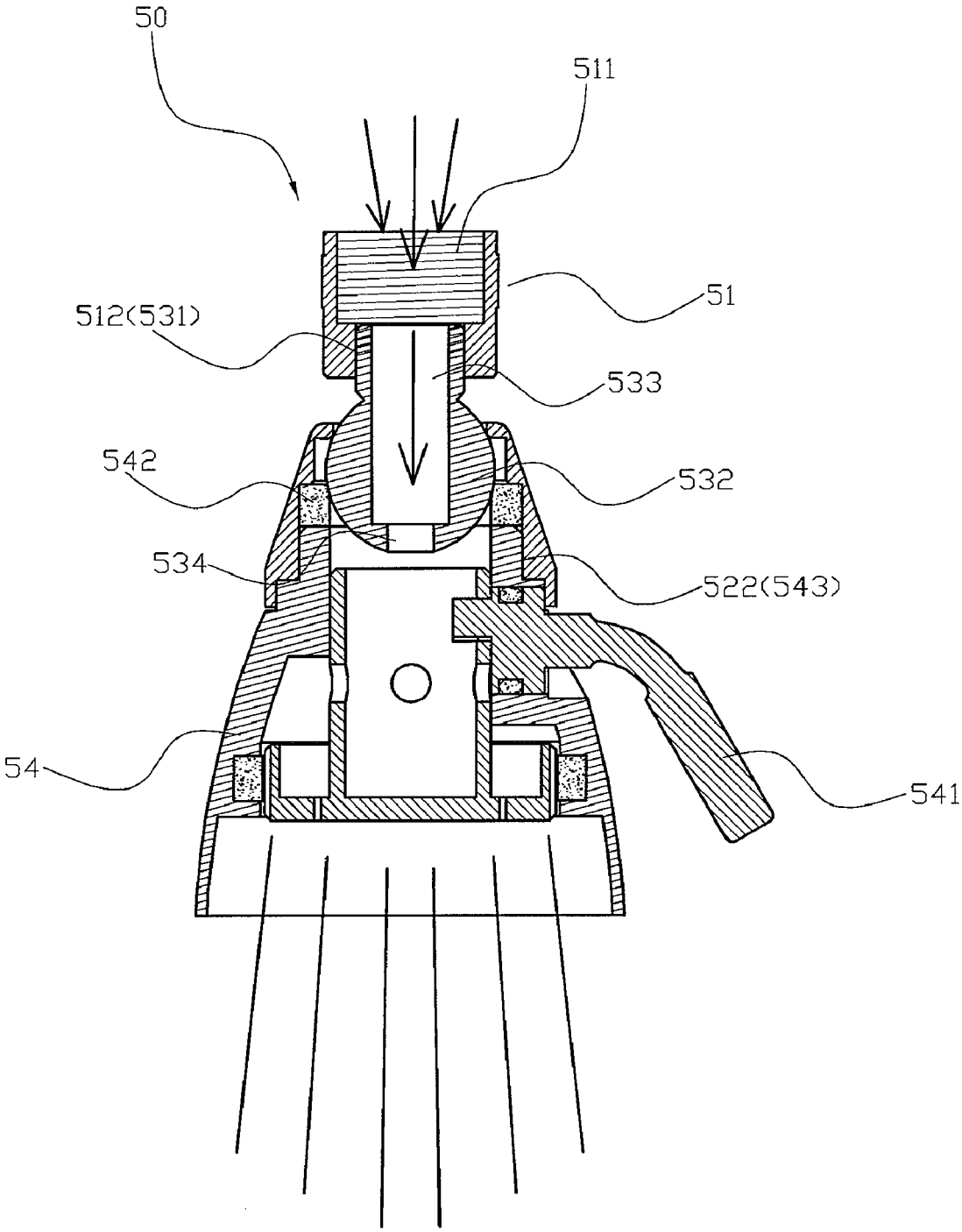
FIG. 6 PRIOR ART
FIG. 6 is a front cross-sectional operational view of the conventional shower head as shown in FIG. 5.

In operation, referring to FIGS. 3 and 4 with reference to FIGS. 1 and 2, when the threaded mounting portion 22 of the quick connector 20 is connected to the water source, the water from the water source in turn flows through the flow channel 21 of the quick connector 20, the through hole 42 of the flow guide member 40, the flow tube 43 of the flow guide member 40, the flow conduit 11 of the bushing 10, the water outlet 23 of the quick connector 20 and the universal connector 33 of the nozzle unit 30 into the nozzle 31 of the nozzle unit 30 and is injected outward from the nozzle 31 of the nozzle unit 30 for use with a user.

At this time, the air conducting apertures 12 of the bushing 10 align with the air conducting holes 25 of the quick connector 20 respectively so that the ambient air is introduced through the air conducting holes 25 of the quick connector 20 and the air conducting apertures 12 of the bushing 10 into the flow conduit 11 of the bushing 10 to break the vacuum state in the shower head and to perturb the water flow in the shower head so as to produce a turbulent flow in the shower head so that the water flow injected from the nozzle unit 30 is broken and divided into multiple straight water beams and multiple irregular water bubbles so as to increase the flushing angle and area of the shower head.

Accordingly, when the water flows through the shower head, the ambient air is introduced through the air conducting holes 25 of the quick connector 20 and the air conducting apertures 12 of the bushing 10 into the flow conduit 11 of the bushing 10 to break the vacuum state in the shower head and to perturb the water flow in the shower head so as to produce a turbulent flow in the shower head so that the water flow injected from the nozzle unit 30 is broken and divided into multiple straight water beams and multiple irregular water bubbles so as to increase the flushing angle and area of the shower head and to enhance the water flushing effect of the shower head. In addition, the ambient air is introduced through the air conducting holes 25 of the quick connector 20 and the air conducting apertures 12 of the bushing 10 into the flow conduit 11 of the bushing 10 to reduce the water pressure in the shower head so that the water is injected from the nozzle unit 30 smoothly and stably so as to provide a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shower head, comprising:

a nozzle unit;

a quick connector mounted on the nozzle unit;

a bushing mounted in the quick connector;

wherein the nozzle unit includes a nozzle, a universal connector having a spherical first end rotatably mounted on the nozzle, and a locking screw member mounted on a second end of the universal connector;

the quick connector has a first end provided with an outer threaded portion screwed into the locking screw member of the nozzle unit;

the quick connector has a second end provided with a threaded mounting portion;

the quick connector has an inner portion formed with a flow channel;

the flow channel of the quick connector has a bottom formed with a reduced water outlet which has a diameter smaller than that of the flow channel;

the quick connector has a peripheral wall formed with two radially opposite air conducting holes;

the air conducting holes of the quick connector are connected to the flow channel;

the flow channel of the quick connector has a peripheral wall formed with two radially opposite limit portions;

the bushing is fully received in the flow channel of the quick connector and has an inner wall formed with a flow conduit connected to the flow channel of the quick connector;

the bushing has a peripheral wall formed with two radially opposite air conducting apertures aligning with the air conducting holes of the quick connector respectively;

the air conducting apertures of the bushing are connected to the flow conduit;

the bushing has an outer wall formed with two radially opposite locking portions locked in the limit portions of the quick connector.

2. The shower head of claim 1, wherein the shower head further comprises:

a first O-ring mounted on the outer wall of the bushing and located in the flow channel of the quick connector;

a second O-ring mounted on the outer wall of the quick connector and located in the locking screw member of the nozzle unit;

the first O-ring is pressed between the bushing and the quick connector to provide an air-tight effect between the bushing and the quick connector;

the second O-ring is pressed between the quick connector and the locking screw member of the nozzle unit to provide an air-tight effect between the quick connector and the locking screw member of the nozzle unit.

3. The shower head of claim 1, wherein each of the limit portions of the quick connector is an elongate slot which extends axially in the flow channel of the quick connector;

each of the locking portions of the bushing is an elongate rib which extends axially on the bushing;

the air conducting holes of the quick connector are disposed between the outer threaded portion and the threaded mounting portion of the quick connector;

the bushing is a hollow stepped cylinder;

the flow conduit of the bushing extends axially through the bushing;

the flow conduit of the bushing has a circular shape;

the flow conduit of the bushing is connected between the flow channel and the water outlet of the quick connector;

the flow channel of the quick connector extends axially through the quick connector;

the water outlet of the quick connector is formed on the second end of the quick connector.

4. The shower head of claim 1, wherein the flow conduit of the bushing has an upper end formed with an inner threaded section;

the shower head further comprises a flow guide member secured in the flow conduit of the bushing to interrupt the flow conduit of the bushing;

the flow guide member has an upper end provided with a threaded disk screwed into the inner threaded section of the bushing;

the threaded disk of the flow guide member has a top whose height is higher than that of each of the air conducting apertures of the bushing;

the flow guide member has a second end provided with a flow tube which is extended into the flow conduit of the bushing;

the flow tube of the flow guide member has a bottom whose height is lower than that of each of the air conducting apertures of the bushing;

the flow guide member has an inner portion formed with a through hole which is connected between the flow channel of the quick connector and the flow conduit of the bushing;

the through hole of the flow guide member extends axially through the threaded disk and the flow tube of the flow guide member;

the flow guide member has a top face formed with an elongate tool insertion slit.

* * * * *